US010858143B2

(12) United States Patent
Block

(10) Patent No.: US 10,858,143 B2
(45) Date of Patent: Dec. 8, 2020

(54) AUTO-ERECTED CARTON BOTTOM AND ASSOCIATED CARTON BLANK

(71) Applicant: The C.W. Zumbiel Company, Hebron, KY (US)

(72) Inventor: Steven J. Block, Amelia, OH (US)

(73) Assignee: The C.W. Zumbiel Company, Hebron, KY (US)

( * ) Notice: Subject to any disclaimer, the term of this patent is extended or adjusted under 35 U.S.C. 154(b) by 0 days.

(21) Appl. No.: 16/388,051

(22) Filed: Apr. 18, 2019

(65) Prior Publication Data

US 2019/0337668 A1 Nov. 7, 2019

Related U.S. Application Data

(60) Provisional application No. 62/664,975, filed on May 1, 2018.

(51) Int. Cl.

| | |
|---|---|
| ***B65D 5/36*** | (2006.01) |
| ***B65D 5/42*** | (2006.01) |
| ***B65D 5/20*** | (2006.01) |
| ***B31B 50/73*** | (2017.01) |
| ***B31B 50/62*** | (2017.01) |
| ***B31B 50/26*** | (2017.01) |
| *B31B 120/30* | (2017.01) |
| *B31B 110/35* | (2017.01) |

(52) U.S. Cl.

CPC ..... *B65D 5/3635* (2013.01); *B31B 50/26* (2017.08); *B31B 50/624* (2017.08); *B31B 50/73* (2017.08); *B65D 5/2076* (2013.01); *B65D 5/4266* (2013.01); *B31B 2110/35* (2017.08); *B31B 2120/302* (2017.08)

(58) Field of Classification Search

CPC .. B65D 5/3635; B65D 5/2076; B65D 5/5266; B65D 5/10; B65D 5/36

USPC ..... 229/117, 184, 155, 183, 930, 920

See application file for complete search history.

(56) References Cited

U.S. PATENT DOCUMENTS

| | | | | | |
|---|---|---|---|---|---|
| 2,388,190 | A | * | 10/1945 | Smart | B65D 5/3621 229/117 |
| 2,879,934 | A | * | 3/1959 | Flynn | B65D 5/3621 229/120.17 |
| 2,900,122 | A | | 8/1959 | Steiner | |
| 3,069,063 | A | * | 12/1962 | King, Jr. | B65D 5/10 229/117 |
| 3,722,782 | A | | 3/1973 | Collie | |
| 4,040,560 | A | * | 8/1977 | Grossman | B65D 5/3607 229/117 |
| 4,142,666 | A | * | 3/1979 | Rosenbaum, II | B65D 5/3621 229/117 |
| 4,341,341 | A | | 7/1982 | Roccaforte | |
| 4,474,324 | A | | 10/1984 | Forbes, Jr. | |

(Continued)

*Primary Examiner* — Christopher R Demeree

(74) *Attorney, Agent, or Firm* — Wood Herron & Evans LLP

(57) ABSTRACT

A carton has an automatically erected bottom that securely closes the bottom of the carton. In one embodiment, the carton blank has two major side panels and two minor side panels serially connected. The carton blank has two bottom flaps which form the bottom of the carton. Each bottom flap is connected to one of the major side panels and one of the minor side panels. The carton blank avoids the erecting and forming issues associated with prior art carton blanks which have an automatically erected bottom.

16 Claims, 10 Drawing Sheets

(56) References Cited

U.S. PATENT DOCUMENTS

| | | | | | |
|---|---|---|---|---|---|
| 4,767,051 | A * | 8/1988 | Single | B65D 5/3621 | 229/117 |
| 5,346,121 | A * | 9/1994 | Beales | B65D 5/0254 | 229/138 |
| 5,458,272 | A * | 10/1995 | Ward-Weber | B65D 5/10 | 229/122.1 |
| 5,887,782 | A * | 3/1999 | Mueller | B65D 5/0227 | 229/117 |
| 5,927,593 | A * | 7/1999 | Berkowitz | B65D 5/3614 | 229/117 |
| 6,079,616 | A * | 6/2000 | Chinks | B65D 5/0005 | 229/101 |
| 6,135,347 | A * | 10/2000 | Mueller | B65D 5/0227 | 206/232 |
| 6,290,123 | B1 * | 9/2001 | Pei | B65D 5/3621 | 229/117 |
| 6,371,363 | B1 * | 4/2002 | Franklin | B65D 5/06 | 229/109 |
| 6,530,516 | B1 * | 3/2003 | Ritter | B65D 5/3621 | 229/117 |
| 7,841,511 | B2 | 11/2010 | Fogle | | |
| 8,950,654 | B2 | 2/2015 | Schultz | | |

* cited by examiner

AUTO-ERECTED CARTON BOTTOM AND ASSOCIATED CARTON BLANK

This claims priority to U.S. Provisional Patent Application Ser. No. 62/664,975, filed May 1, 2018 and hereby incorporated by reference in its entirety.

BACKGROUND OF THE INVENTION

A wide variety of carton and associated carton blanks are known, some with very specific designs to accomplish specific objectives. One such design is commonly referred to as an automatic erecting bottom or auto-erecting bottom. Such cartons derive their name from the utility of having the bottom of the carton being formed as the side panels of the carton are folded relative to each other into a parallelepiped or similar configuration. Examples of auto-erecting bottom cartons are disclosed in U.S. Pat. Nos. 2,900,122; 3,722,782; 4,341,341; 4,474,324; 7,841,511 and 8,950,654, each of which is hereby incorporated by reference in its entirety.

The process of folding an auto-erected bottom carton from a blank into a carton is typically automated by having the carton blanks processed in a machine at a high rate of speed to obtain manufacturing efficiencies and avoid repetitive manual manipulation of the carton blanks. One of the steps in the automated folding process of prior art auto-erected bottom cartons is shown in FIGS. 1A-1B. A bottom flap 3 of a blank 1 is joined to a major panel 5 of the carton blank 1 by a bottom flap fold line 7. The bottom flap 3 of the carton blank 1 in FIGS. 1A-1B includes a transverse or diagonal fold line 9 which defines a triangular flap portion 11 of the bottom flap 3.

The automated folding of the prior art carton blank 1 of FIGS. 1A-1B may include the processing of a series of such carton blanks along a machine direction indicated by the MD arrow in FIGS. 1A-1B. At a relatively early stage in the process, a hook 13 on the distal end of an arm 15 engages the flap 3 as the blank 1 passes under the arm 15. The hook 13 engages the bottom flap 3 near the free edge of the flap 3 and folds the bottom flap 3 about the flap fold line 7 in the direction of arrow A and onto the panel 5 of the carton blank 1. A fixed shelf 17 is positioned adjacent to the hook 13 and arm 15, but slightly downstream therefrom. The shelf 17 engages the triangular flap portion 11 as the flap 3 is folded onto the panel 5 so as to fold the triangular flap portion 11 about the transverse fold line 9 to position the triangular flap portion 11 on the remainder of the bottom flap 3 as shown in FIG. 1B. The upwardly exposed face of the triangular flap portion 11 receives a deposit of adhesive (not shown) to adhere it to a flap extending from an adjacent panel for forming the carton bottom while subsequently erecting the blank 1 into a carton.

However, the speed at which the carton blanks 1 pass in the machine direction MD is very high and the need to repeatedly and accurately fold the bottom flap 3 and triangular flap portion 11 is critical to the efficient and reliable processing of the blanks 1. Unfortunately, the manipulation of the prior art auto-erecting carton blank 1 as represented in FIGS. 1A-1B has proven to be problematic and frequently the cause for the need to stop the machine and associated processing of the blanks. This is very detrimental to the efficient and reliable processing of the auto-erected bottom blanks into cartons.

SUMMARY OF THE INVENTION

These and other shortcomings with known blanks and associated cartons with auto-erected bottoms have been addressed with this invention which in various embodiments is a carton blank, a carton with an auto-erected bottom and a process for forming the blank into such a carton.

A carton according to one embodiment of this invention has an automatically erected bottom that securely closes the bottom of the carton. In one embodiment, the carton blank has two major side panels and two minor side panels serially connected. The carton blank has two bottom flaps which form the bottom of the carton. Each bottom flap is connected to one of the major side panels and one of the minor side panels.

The carton blank avoids the erecting and forming issues associated with prior art carton blanks which have an automatically erected bottom.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 2:
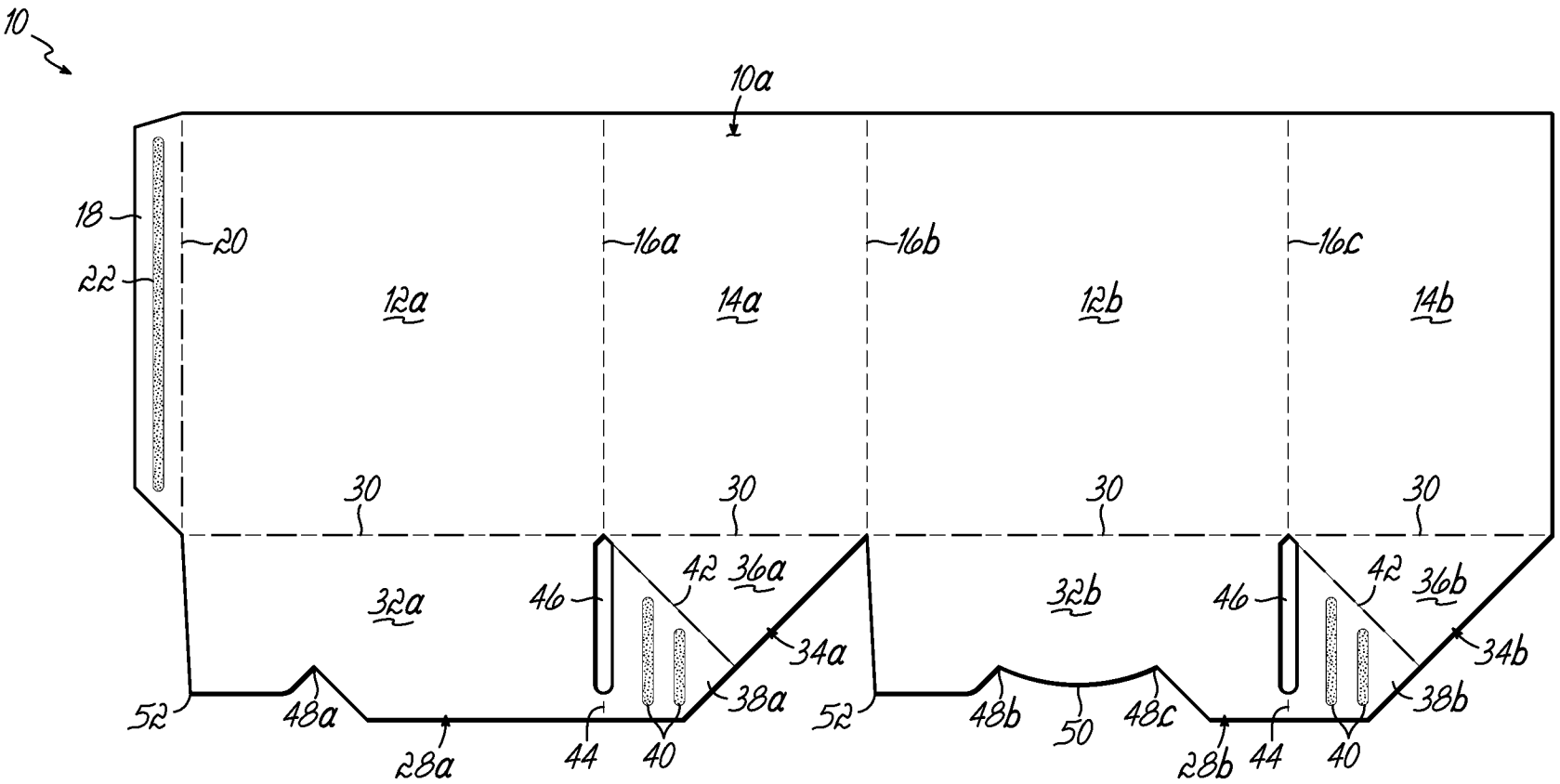
FIG. 2 is a plan view of a carton blank according to one embodiment of this invention.
Figure 3:
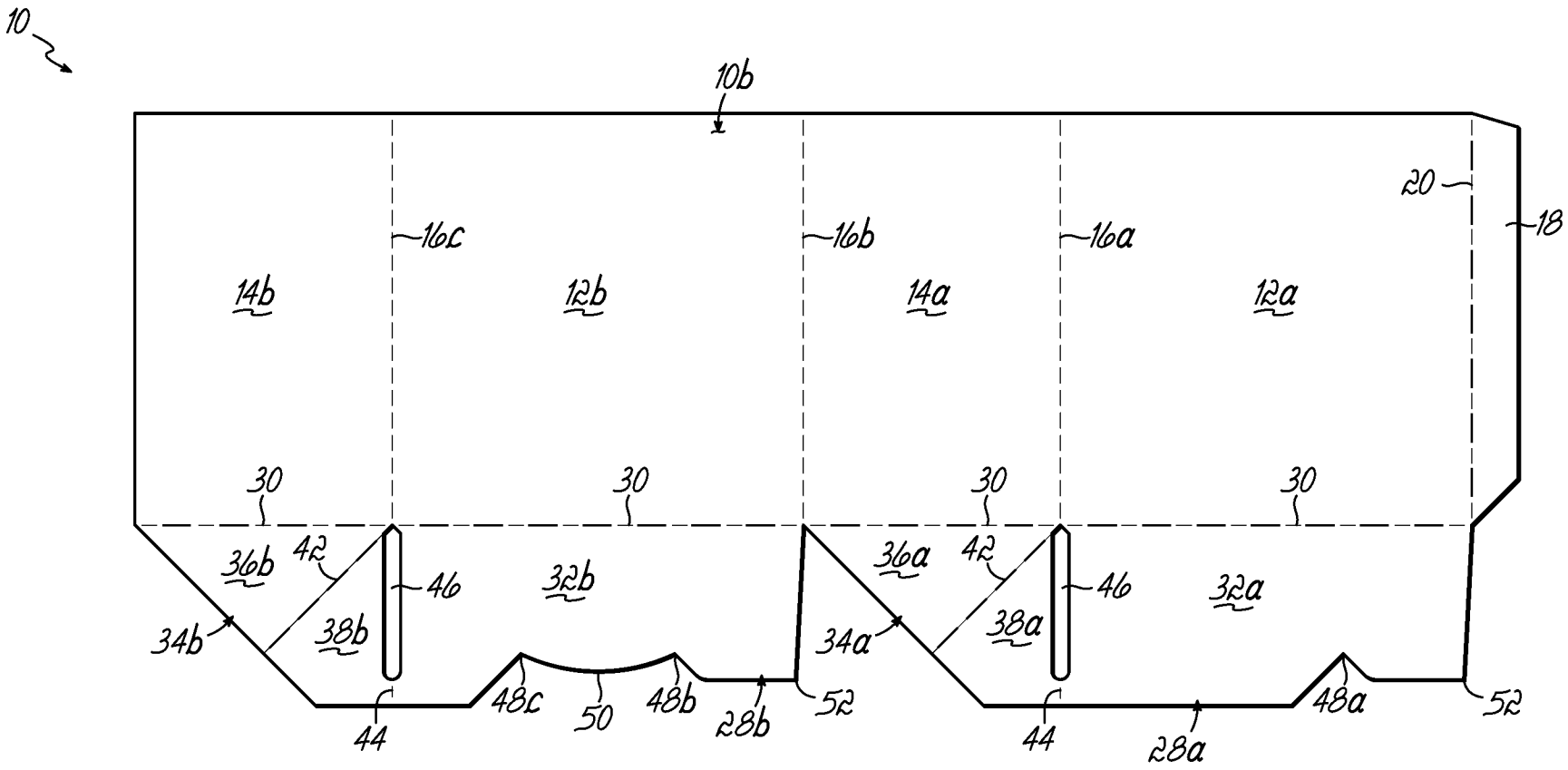
FIG. 3 is a plan view of an opposite face of the carton blank of FIG. 2.

Referring to FIGS. 2-3, a first embodiment of a carton blank 10 according to this invention is shown. An outer face boa of the blank is shown in FIG. 2 and an inner face bob is shown in FIG. 3. The carton blank 10 includes two major side panels 12*a*, 12*b* and two minor side panels 14*a*, 14*b* each serially connected to and interspersed with one another and separated by side panel fold lines 16*a*, 16*b*, 16*c*. Attached to one of the major side panels 12*a* is a glue flap 18 which is attached by a glue flap fold line 20. The glue flap 18 may include a deposit of adhesive 22 and can be joined to the opposite end of the carton blank 10 at the minor side panel 14*b* to form a generally rectangular-shaped carton 24 (see FIG. 10).

Figure 10:
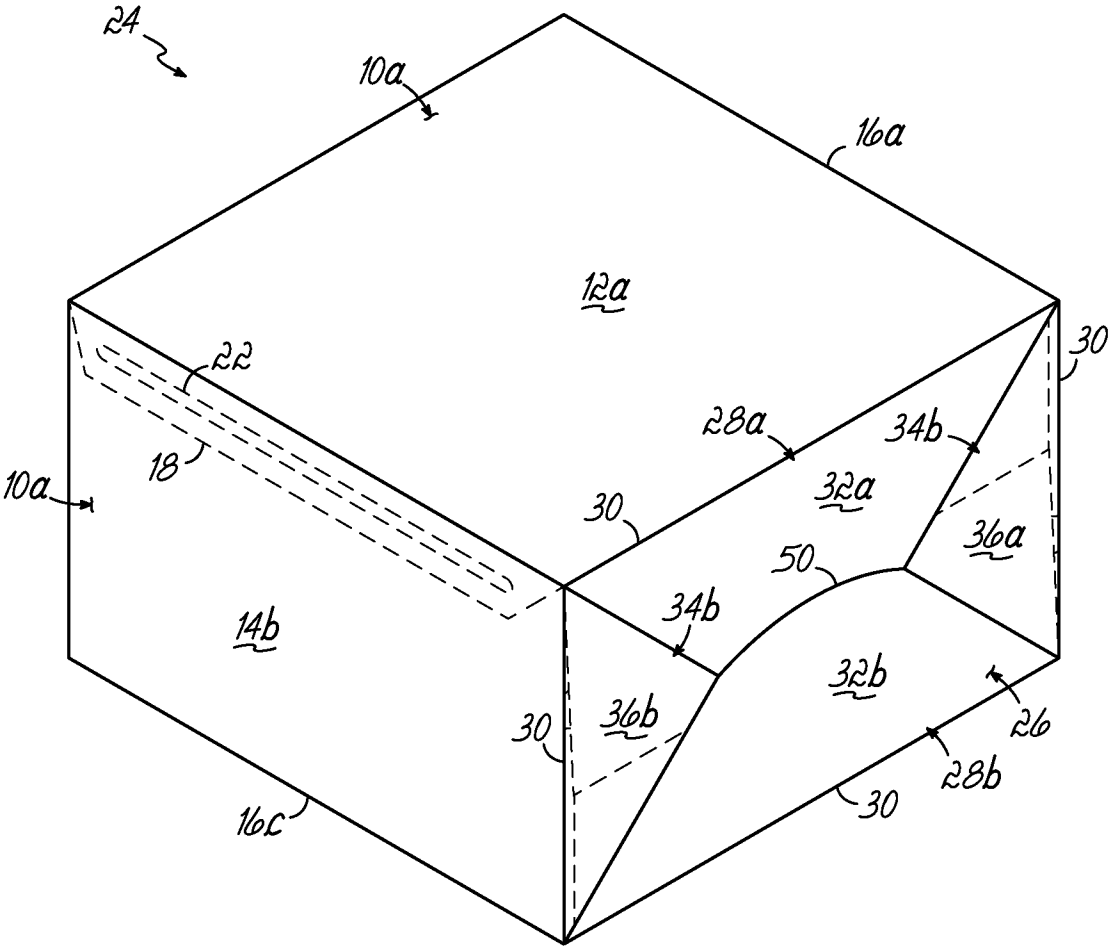
FIG. 10 is a perspective view of a carton erected from the carton blank of FIG. 2.

According to the embodiment of FIGS. 2-3, the carton blank 10 is used to erect the carton 24 as shown in FIG. 10. The carton 24 and associated carton blank 10 according to this embodiment has an open top; however, it will be appreciated by one of ordinary skill in the art that this invention is not limited to a carton and associated carton blank with an open top, but may include a closed top in other embodiments. A bottom 26 of the carton 24 as shown in FIG. 10 is formed from two bottom flaps 28*a*, 28*b* joined to the major and minor side panels 12, 14 by a bottom flap fold line 30. Each bottom flap 28 spans one major side panel 12 and one minor side panel 14 as shown in FIGS. 2-3. Each bottom flap 28 includes a major panel flap portion 32 which is aligned with and extends from the associated major side panel 12. Each bottom flap 28 also includes a minor panel flap portion 34 which is aligned with and extends from the associated minor side panel 14. Each minor panel flap portion 34*a*, 34*b* includes a triangular flap portion 36*a*, 36*b* and an adhesive flap portion 38*a*, 38*b*. The adhesive flap portion 38 may include one or more deposits of adhesive 40 on the outer face boa of the carton blank 10 as is the deposit of adhesive 22 on the glue flap 18 as shown in FIG. 2. The adhesive flap portion 38 is joined to the triangular flap portion 38 by a tuck flap fold line 42. Each minor panel flap portion 34 is joined to the major panel flap portion 32 of the associated bottom flap 28 by a flap fold line 44 which is aligned with the side panel fold line 16 joining the associated major side panel 12 and minor side panel 14. An aperture or cut-out 46 is also provided in each bottom flap 28 and has an elongate shape aligned with the side panel fold line 16 joining the associated major and minor side panels. The aperture 46 assists in the folding of the carton blank 10 as described herein below.

A free edge of each bottom flap 28 has a shape and configuration which enables the bottom 26 of the carton 24 to be automatically erected and closed during the formation of the carton blank 10 into the carton 24. Specifically, one or more notches 48 are provided along the free edge of each bottom flap 28. One such notch 48*a* is provided on the bottom flap 28*a* adjacent to the glue flap 18 of the carton blank 10. Two such notches 48*b*, 48*c* are provided in the bottom flap 28*b* spaced from the glue flap 18 and those two notches are separated by an arcuate flap edge 50 as seen in FIGS. 2-3. Each bottom flap 28 also has a corner 52 as seen in FIGS. 2-3. Each corner 52 will be tucked between the triangle flap portion 36 and the adhesive flap portion 38 of the other bottom flap 28 as will be described herein below when the carton bottom 26 is formed.

Figure 4:
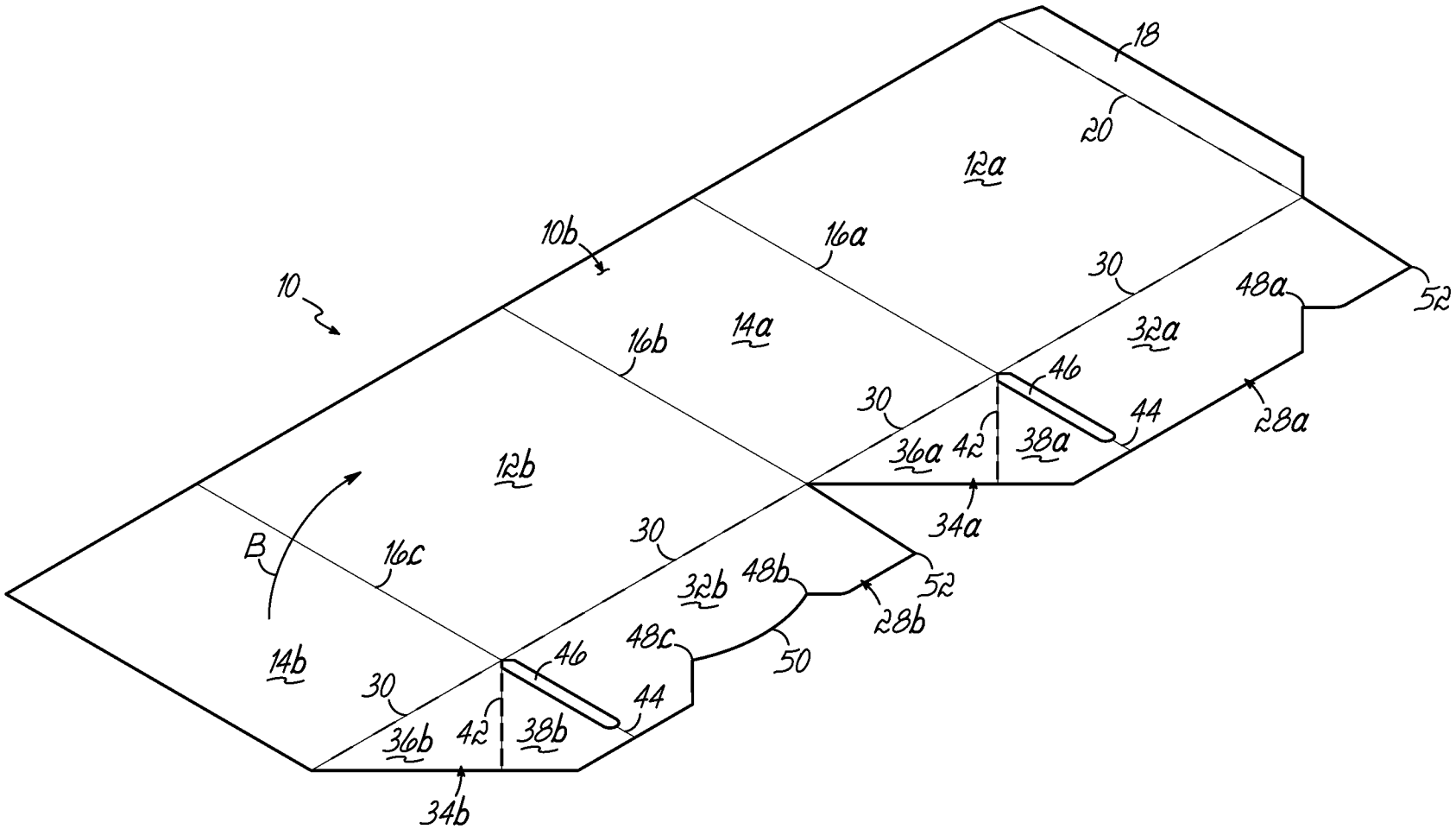
FIGS. 4-7 are sequential perspective views of the carton blank of FIG. 2 being folded toward an erected configuration.
Figure 5:
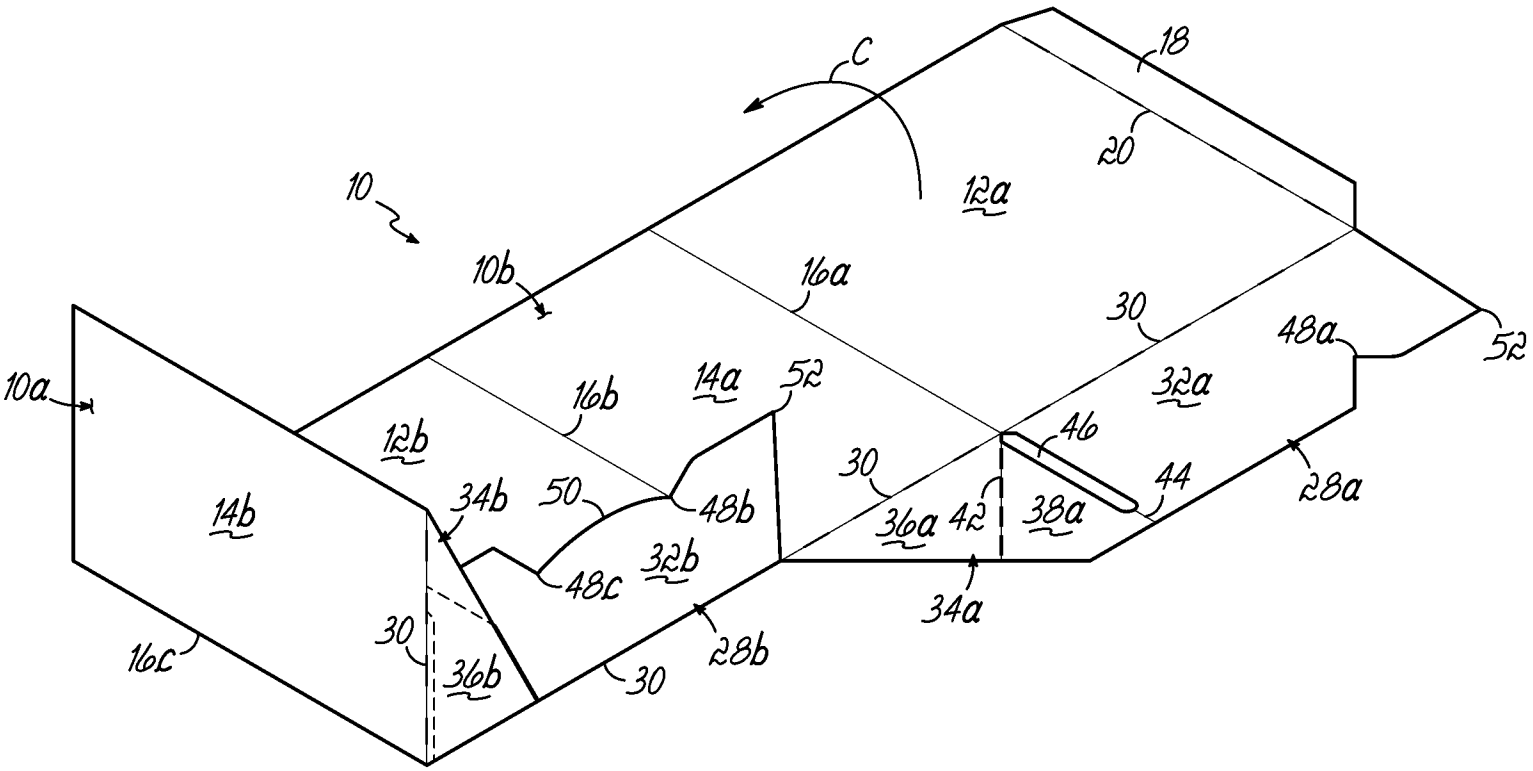

The sequence of folding and erecting the carton 24 of FIG. 10 from the carton blank 10 of FIGS. 2 and 3 is shown sequentially in FIGS. 4-9A according to one aspect of this invention. Initially, the carton blank 10 is in a generally planar configuration and the minor side panel 14*b* opposite from the glue flap 18 is folded upwardly about fold line 16*c* to be generally perpendicular to the adjacent major side panel 12*b*, as shown by arrow B in FIG. 4. Folding the minor side panel 14*b* in this way will likewise force the associated minor panel flap portion 34*b* to fold along the tuck flap fold line 42. Likewise, the major panel flap portion 32*b* will pivot upwardly about fold line 30 to be generally perpendicular to the associated major side panel 12*b* as shown in FIG. 5.

During the folding of the carton blank 10 as represented in FIGS. 4 and 5, the triangular flap portion 36 will fold so as its outer face will be in face-to-face juxtaposition with the outer face of the adhesive flap portion 38. The outer face of the adhesive flap portion 38 which includes the deposits of adhesive 40 will adhere to the outer face of the triangular flap portion 36. The inner face of the major panel flap portion 32 is juxtaposed, but not adhered to the inner face of the adhesive flap portion 38 forming a slot 54 therebetween into which the corner 52 of the other bottom flap 28 will be inserted. Subsequently, the major side panel 12*a* and associated glue flap 18 are folded upwardly in the direction of arrow C as shown in FIG. 5 to be generally perpendicular to the adjacent minor side panel 14*a*.

Figure 6:
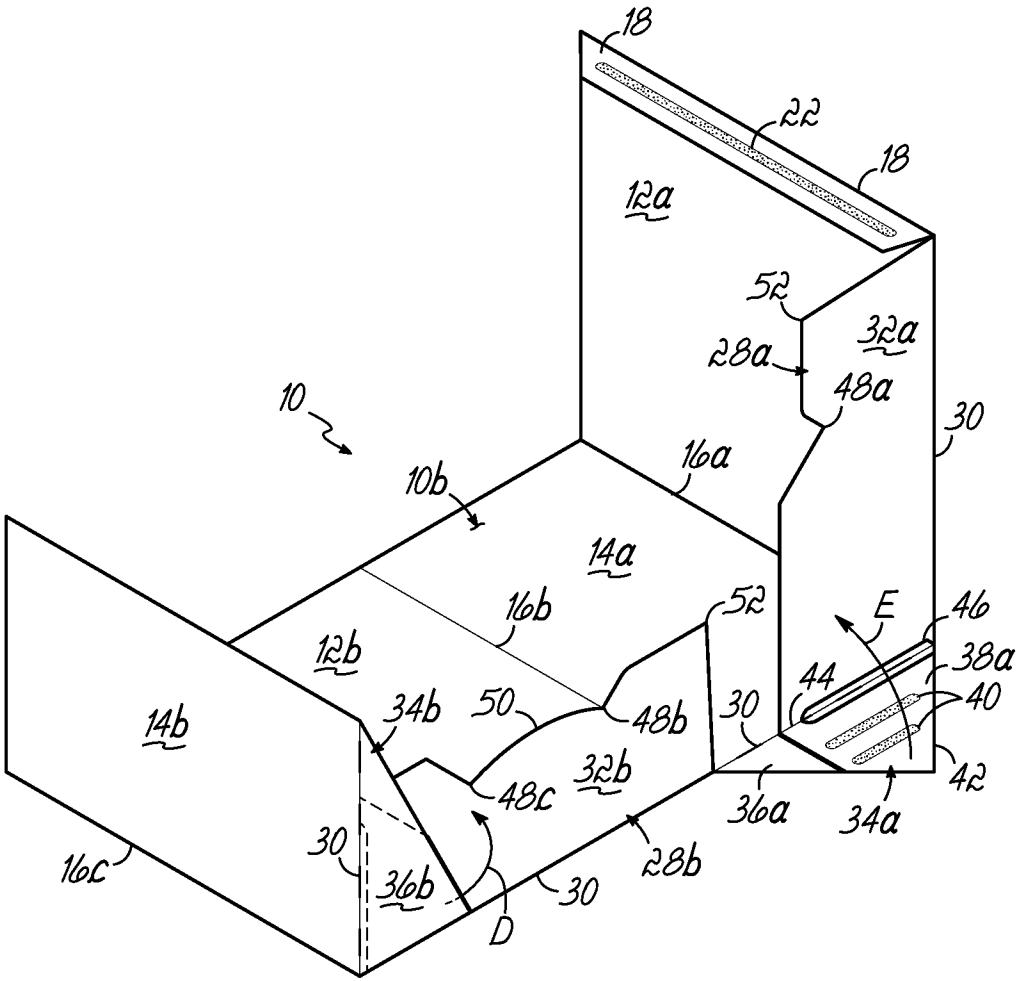
Figure 7:
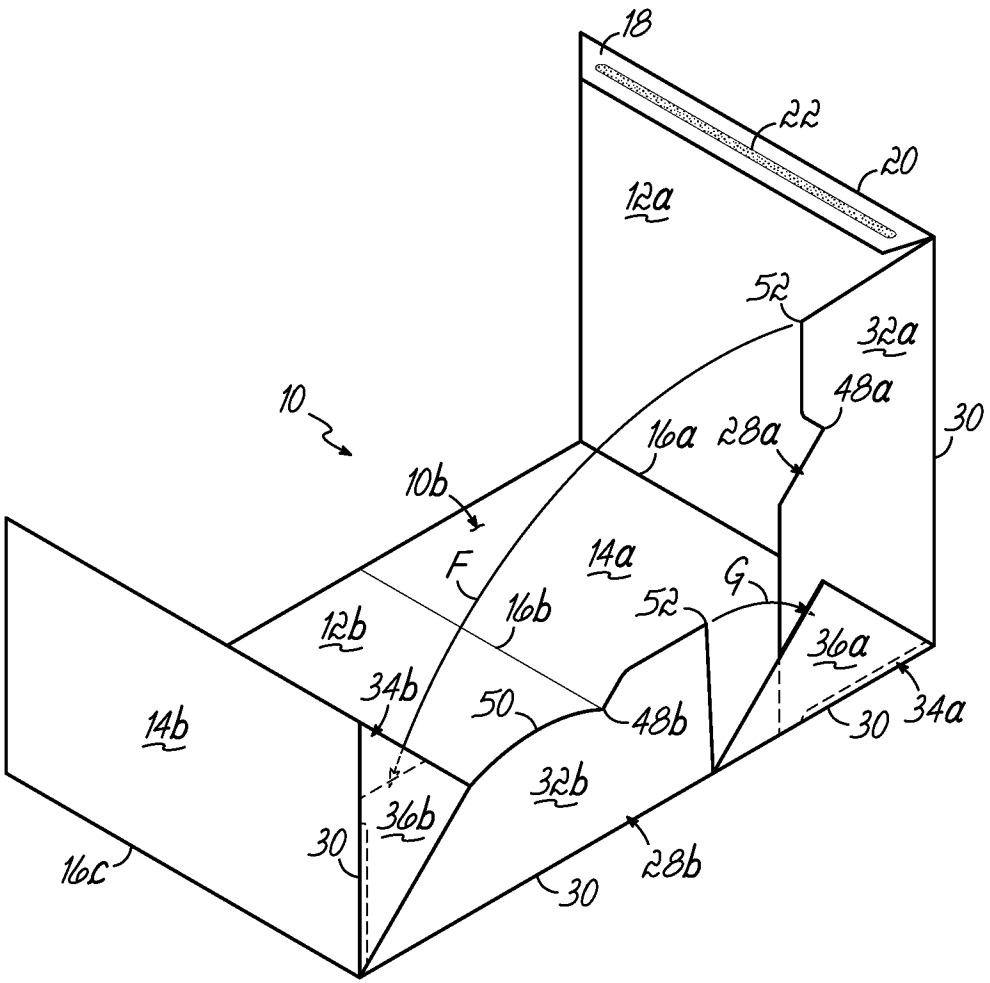
Figures 8, 8A:
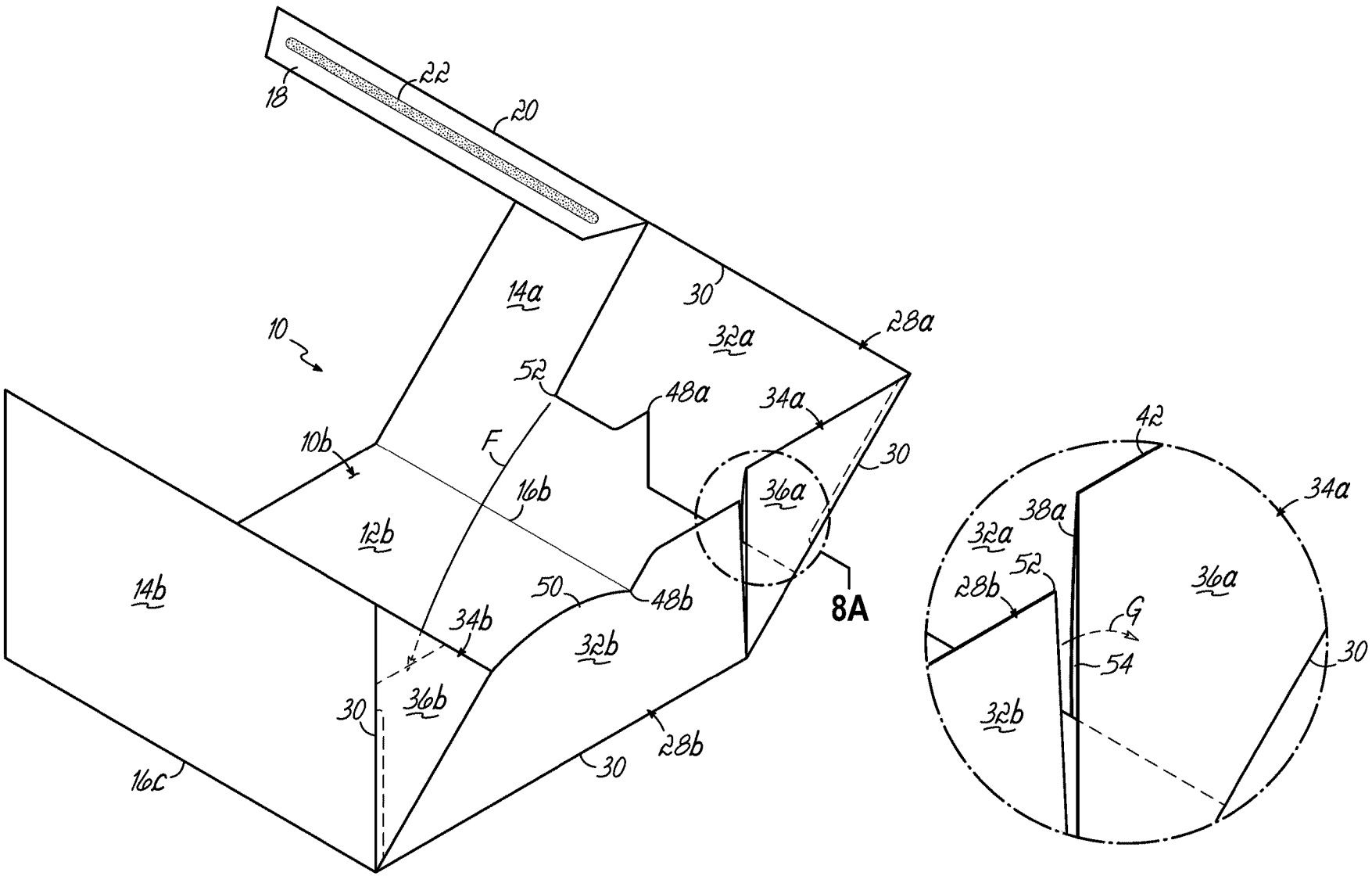
FIGS. 8 and 9 are further sequential views of the folding process of FIGS. 4-7.
FIGS. 8A and 9A are enlarged views of the areas 8A and 9A, respectively, from FIGS. 8 and 9, respectively.
Figure 9A:
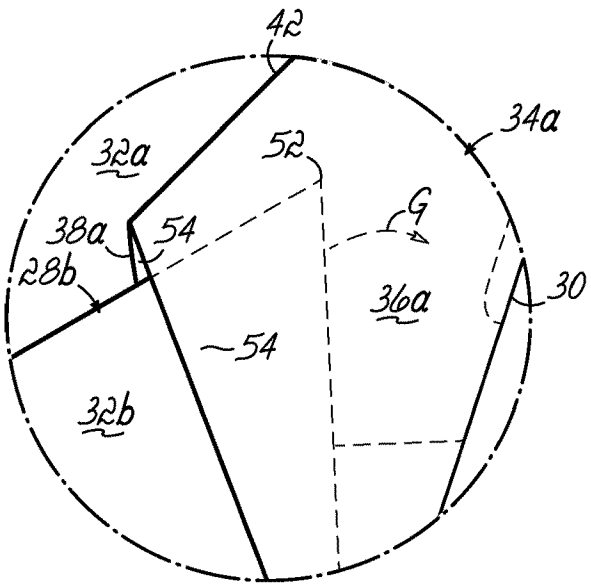
Figure 9:
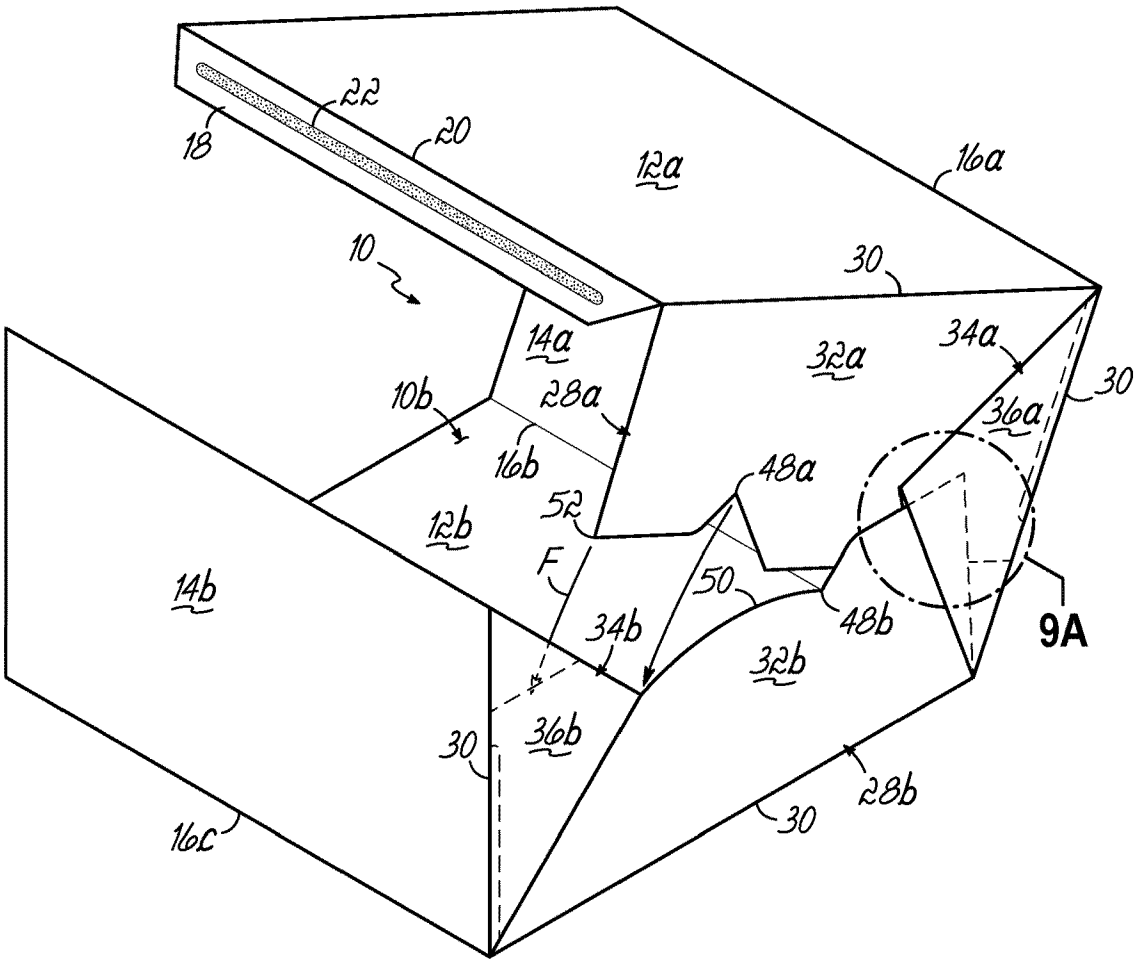

During the folding of the major side panel 12*a* as shown in FIG. 5, the associated major panel flap portion 32*a* is folded about the fold line 30 to be generally perpendicular to the adjacent major side panel 12*a*. During the folding of the major panel bottom flap 32*a* as shown in FIG. 6, the associated minor panel flap portion 34*a* is likewise folded about the tuck flap fold line 42. The triangular flap portion 36*a* of the minor panel flap portion 34*a* is folded to be perpendicular to both the adjoining minor side panel 14*a* and the adjacent major side panel 12*a*. The deposit of adhesive 40 on the adhesive flap portion 38*a* is then adhered to the outer face of the triangular flap portion 36*a*. It will be noted that the inner face 10*b* of the adhesive flap portion 38*a* is not adhered to the major panel flap portion 32 of the bottom flap 28 forming a slot 54 therebetween for each of the bottom flaps 28 of the carton blank 10. The aperture 46 is aligned with the fold line 30 when the bottom flaps 28 are folded to help facilitate the folding process and minimize the carton blank material at the fold location.

As shown in FIGS. 7-9A, to erect the bottom 26 of the carton 24, the opposite portions of the partially folded carton blank 10 are pivoted toward one another about fold line 16*b* to join the glue flap 18 to the inner face at the opposite free edge of the carton blank 10 along the minor side panel 14*b*. By doing so, the corner 52 of the major panel flap portion 32 is inserted into the opposite slot 54 and between the inner faces of the major panel flap portion 36 of the other bottom flap and the adhesive flap portion 38. By doing so, the notch 48*a* is seated within the notch 48*b* of the opposite flap thereby completing the formation of the erected bottom 26 of the carton 24 as shown in FIG. 10. The arcuate flap edge 50 of the bottom flap 32*b* is juxtaposed outside of the adjacent portion of the bottom flap 32*a* on the bottom 26 of the formed carton 24.

Figure 1B:
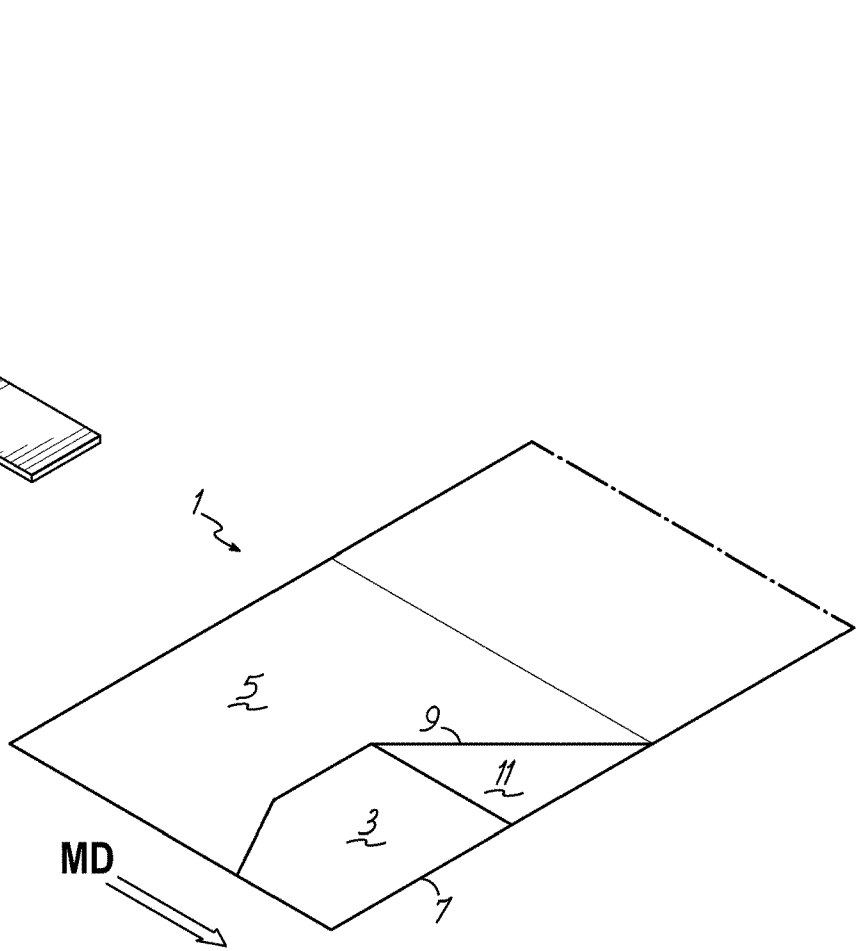
FIG. 1B PRIOR ART
FIG. 1B is a perspective view of a portion of the carton blank of FIG. 1A in a folded configuration.
Figure 1A:
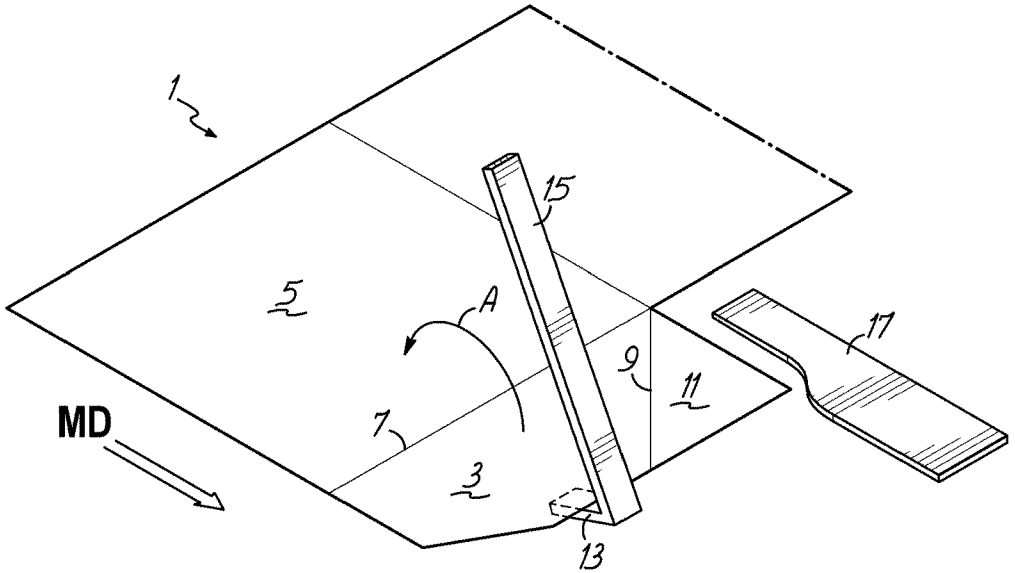
FIG. 1A PRIOR ART
FIG. 1A is a schematic perspective view of a prior art carton blank being folded and advancing in a machine direction.

As such, the bottom 26 of the carton 24 is auto-erected without the hook and folding operation of prior art carton blank designs as shown in FIGS. 1A-1B.

From the above disclosure of the general principles of this invention and the preceding detailed description of at least one embodiment, those skilled in the art will readily comprehend the various modifications to which this invention is susceptible. Therefore, I desire to be limited only by the scope of the following claims and equivalents thereof.

I claim:

1. A carton blank comprising:

a first, a second, a third and a fourth side panel;

a first bottom flap foldably connected to a bottom edge of each of the first and second side panels;

a second bottom flap foldably connected to a bottom edge of each of the third and fourth side panels;

a first bottom flap corner and a second bottom flap corner on a free edge of the first bottom flap and on a free edge of the second bottom flap, respectively; and the first and second bottom flaps cooperating to form a bottom of a carton when the carton blank is erected into the carton with the first bottom flap corner being juxtaposed between folded portions of the second bottom flap and the second bottom flap corner being juxtaposed and inserted between folded portions of the first bottom flap.

2. The carton blank of claim 1 wherein each of the first and second bottom flaps further comprise:

a minor panel flap portion; and a major panel flap portion.

3. The carton blank of claim 2 further comprising:

an aperture positioned between each major panel flap portion and the associated minor panel flap portion.

4. The carton blank of claim 3 wherein each side panel is joined to an adjacent side panel via a side panel fold line and the aperture between major panel flap portion and the associated minor panel flap portion is aligned with the side panel fold line between the associated side panels.

5. The carton blank of claim 2 wherein each of the minor panel flap portions further comprise:

a triangular flap portion;

an adhesive flap portion; and an adhesive on the adhesive flap portion to thereby adhere the adhesive flap portion to the associated major panel flap portion when the carton blank is formed into the carton.

6. The carton blank of claim 1 wherein each of the first and second bottom flaps further comprise:

a triangular flap portion; and an adhesive flap portion.

7. The carton blank of claim 6 wherein the first bottom flap corner is juxtaposed between the triangular flap portion and the adhesive flap portion of the second bottom flap and the second bottom flap corner is juxtaposed between the triangular flap portion and the adhesive flap portion of the first bottom flap when the carton blank is formed into the carton.

8. The carton blank of claim 1 wherein the first, second, third and fourth side panels are serially connected together.

9. The carton blank of claim 1 wherein a free edge of the first bottom flap has a first notch which mates with a second notch on a free edge of the second bottom flap when the carton blank is formed into the carton.

10. The carton blank of claim 1 further comprising:

a glue flap joined to the first side panel via a glue flap fold line, wherein the glue flap is joined to the fourth side panel via a deposit of glue when the carton blank is formed into the carton.

11. A carton blank comprising:

a first, a second, a third and a fourth side panel serially connected to together;

a first bottom flap foldably connected to a bottom edge of each of the first and second side panels;

a second bottom flap foldably connected to a bottom edge of each of the third and fourth side panels;

a first bottom flap corner and a second bottom flap corner on a free edge of the first bottom flap and on a free edge of the second bottom flap, respectively;

wherein each of the first and second bottom flaps further comprises a minor panel flap portion and a major panel flap portion and each minor flap portion further comprises a triangular flap portion and an adhesive flap portion;

the bottom flaps cooperating to form a bottom of a carton when the carton blank is erected into the carton with the first bottom flap corner being juxtaposed between the triangular flap portion and the adhesive flap portion of the second bottom flap and the second bottom flap corner is juxtaposed and inserted between the triangular flap portion and the adhesive flap portion of the first bottom flap when the carton blank is formed into the carton such that the first and second bottom flap corners are concealed between the associated triangular flap portion and the adhesive flap portion.

12. The carton blank of claim 11 wherein a free edge of the first bottom flap has a first notch which mates with a second notch on a free edge of the second bottom flap when the carton blank is formed into the carton.

13. The carton blank of claim 11 further comprising:

a glue flap joined to the first side panel via a glue flap fold line, wherein the glue flap is joined to the fourth side panel via a deposit of glue when the carton blank is formed into the carton.

14. The carton blank of claim 11 further comprising:

an aperture positioned between each major panel flap portion and the associated minor panel flap portion.

15. The carton blank of claim 14 wherein each side panel is joined to an adjacent side panel via a side panel fold line and the aperture between major panel flap portion and the associated minor panel flap portion is aligned with the side panel fold line between the associated side panels.

16. The carton blank of claim 11 further comprising:

an adhesive on each adhesive flap portion to thereby adhere the adhesive flap portion to the associated major panel flap portion when the carton blank is formed into the carton.

* * * * *